United States Patent [19]

Bush et al.

[11] 4,284,200

[45] Aug. 18, 1981

[54] CHILD-RESISTANT DISPENSING CLOSURE

[75] Inventors: Randall G. Bush; Peter P. Gach, both of Evansville, Ind.

[73] Assignee: Sunbeam Plastics Corporation, Evansville, Ind.

[21] Appl. No.: 80,512

[22] Filed: Oct. 1, 1979

[51] Int. Cl.[3] ..... B65D 55/02

[52] U.S. Cl. ..... 215/215; 215/224; 215/321; 220/284; 220/306; 220/375; 220/254; 222/153; 222/545

[58] Field of Search ..... 215/215, 224, 225, 306, 215/317, 321; 220/306, 375, 254, 284; 222/545, 562, 482, 153, 536

[56] References Cited

U.S. PATENT DOCUMENTS

| | | | |
|---|---|---|---|
| 3,016,168 | 1/1962 | Larson | 222/545 X |
| 3,140,019 | 7/1964 | Barr | 222/482 X |
| 3,542,235 | 11/1970 | Hidding | 222/153 X |
| 3,851,805 | 12/1974 | Hazard | 222/536 X |
| 4,000,839 | 1/1977 | Tecco et al. | 220/254 X |
| 4,082,201 | 4/1978 | Bittel | 215/306 X |

*Primary Examiner*—George T. Hall

*Attorney, Agent, or Firm*—Fisher, Gerhardt, Crampton & Groh

[57] ABSTRACT

A one-piece child-resistant dispensing closure for a container which has an open end. The closure has a skirt which mates with the end of the container and a top which spans the space defined by the skirt. Preferably there are two dispensing openings through the top, each of which is surrounded by an upwardly extending rim. The closure also comprises a lid for each opening and a hinge for each lid. The hinges and lids are integral parts of the closure. The lids have similar rims which fit around the rims on the closure top when the lids are swung over to close the dispensing openings. In the closed position, ribs on the edges of the pairs of opposed rims snap over each other and ears on the inner sides of the lids are closely spaced from a fulcrum on the closure top. The engagement of the ribs holds the lids closed. Pry means, such as a coin or blade, may be inserted between the fulcrum and a lid ear to pry the particular lid open.

2 Claims, 10 Drawing Figures

CHILD-RESISTANT DISPENSING CLOSURE

BACKGROUND OF THE INVENTION

Many types and styles of dispensing closures have been provided which consist of end pieces for the containers and moveable members which can be slid or rotated to open or close dispensing openings, such as a group of perforations or a single larger opening, through which an instrument such as a spoon may be inserted to remove a measured quantity of the material in the container.

The costs of such two part dispensing closures are unnecessarily high because each of the parts must be separately fabricated and they must be assembled to each other before they can be attached in one way or another to the ends of the containers with which they are associated.

In addition, few if any dispensing closures, particularly those for dangerous or harmful materials, such as insecticides, fertilizers, scouring powders, or the like, possess child resistant features which render them difficult if not impossible of opening by a child of tender years, say 6 years of less.

In addition, while some dispensing closures do have tamper indicating means the combination of all of the objectives, i.e., low cost, child resistance and tamper indication in a single dispensing closure is an objective not yet achieved.

It is, therefore, the principal object of the instant invention to provide a child-resistant dispensing closure which is a unitary structure and all the parts of which may be molded in a single cavity of an injection molding machine, thereby reducing the cost of manufacture.

It is yet another object of the instant invention to provide a unitary, child-resistant dispensing closure particularly effective for use on containers of dangerous materials and which requires the use of a pry-means, such as a coin or the blade of a screw driver, to be opened in order to result in it being much less likely that access to the content material will be achieved by a small child.

And yet another object of the instant invention is to provide a child-resistant dispensing closure which also has tamper indicating means.

BRIEF DESCRIPTION OF THE DRAWINGS

FIG. 5A is a fragmentary, sectional view on a greatly enlarged scale of that portion of FIG. 5 indicated by the legend "See FIG. 5A" of FIG. 5;

DESCRIPTION OF PREFERRED EMBODIMENTS

Figure 1:
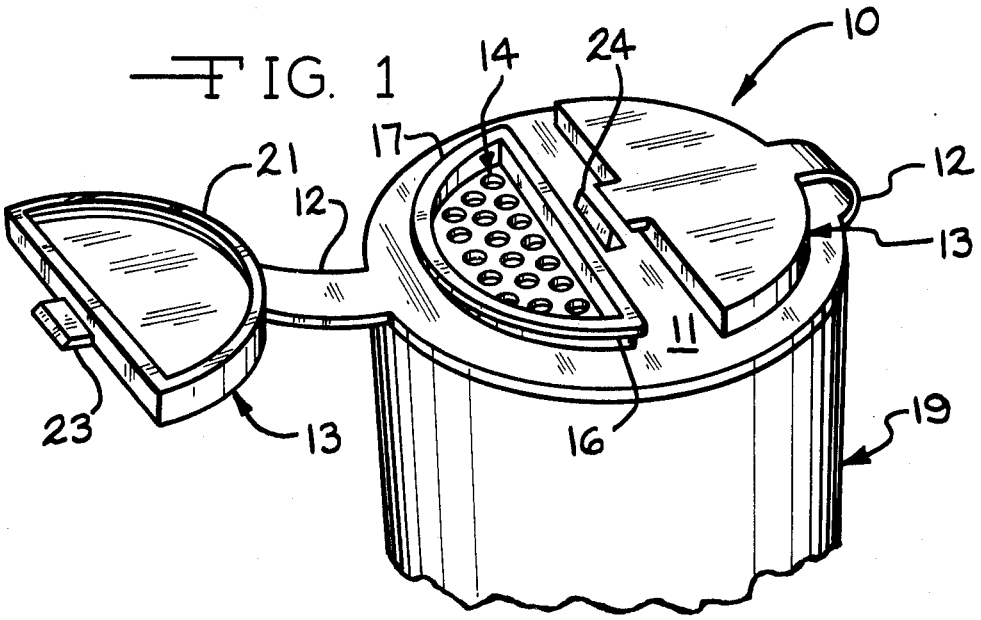
FIG. 1 is a fragmentary view in perspective of a container equipped with a closure embodying the invention.
Figure 2:
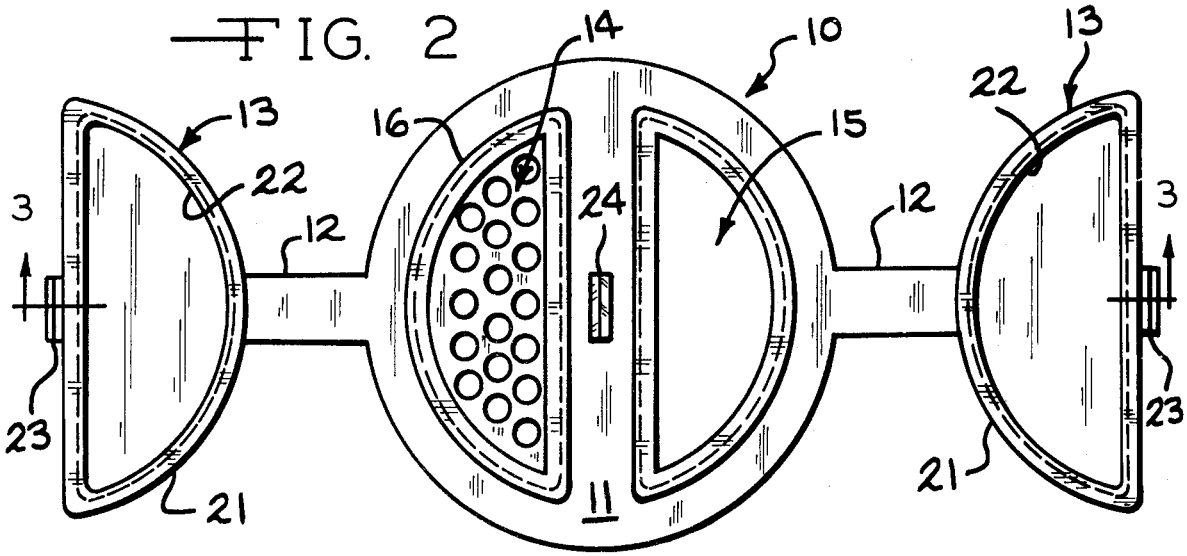
FIG. 2 is a top plan view of the closure of FIG. 1 with its parts in the configuration in which they initially are fabricated.
Figure 3:
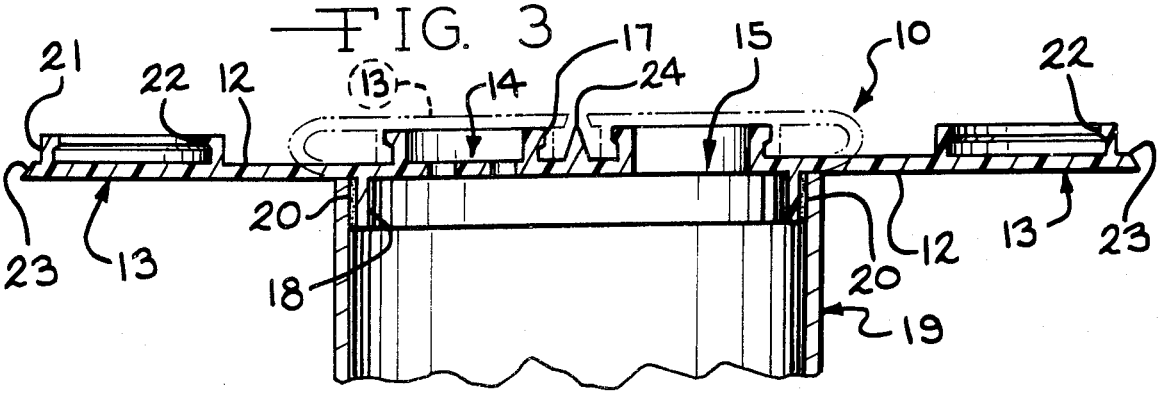
FIG. 3 is a vertical sectional view taken along the line 3—3 of FIG. 2 and showing such closure on the end of a container.

A closure embodying the invention, generally indicated by the reference number 10 as illustrated in FIGS. 1–3 inclusive, consists of a generally circular top 11 two outwardly extending integral hinges 12 and two lids 13. Although not essential to the invention, the lids 13 are identical in configuration, one being a mirror image of the other, as determined by the shapes of two dispensing openings through the closure top 10, each of them being segment-shaped, one opening 14 being formed by a series of perforations through the closure top 11 and the other dispensing opening 15 being a cut out. Each of the dispensing openings 14 and 15 is surrounded by an upwardly extending rim 16 which has an outwardly extending lip 17 at its top edge.

The closure 10 also has a skirt 18 which is designed to mate with the end of the container on which it is to be used, in this instance a tubular fiber board container generally indicated by the reference number 19. The closure 10 is attached to the container 19 by glue generally indicated by the reference number 20.

Each of the lids 13 has a rim 21 of such size as to fit around the adjacent one of the top rims 16 and each of the rims 21 has an inwardly extending lip 22 (which best can be seen in FIG. 3) of such size as to snap over and around the lip 17 on the respective one of the top rims 16.

Each of the lids 13 has an outwardly extending ear 23 of such size and configuration that when the respective lid is in the closed position (shown in phantom in FIG. 3), the edge of the ear 23 is closely spaced from an upwardly extending fulcrum 24 on the top 11 that is located between the inner sides of the top rims 16. When a lid 13 is in closed position the closely spaced adjacency of the fulcrum 24 and the ear 23 provides a narrow space there between into which pry-means such as a coin, a blade of a screw driver, or the like, may be inserted by the user in order to pry off the lid 13 to enable material to be dispensed from the container 18.

Closures according to the invention preferably should be molded from polyethylene although polypropylene and other similar resinous materials also may be employed.

Although, the two lids 13, openings 14 and 15 and their rims 16 and 21 of the closure illustrated in FIGS. 1–3 are shown as being of the same size and shape, other closures embodying the invention may be designed to have openings of different shapes and different sizes. It is necessary only that the associated openings and lids be of such size and shape that the openings are closed when the lids are swung over into closed position.

Figure 4:
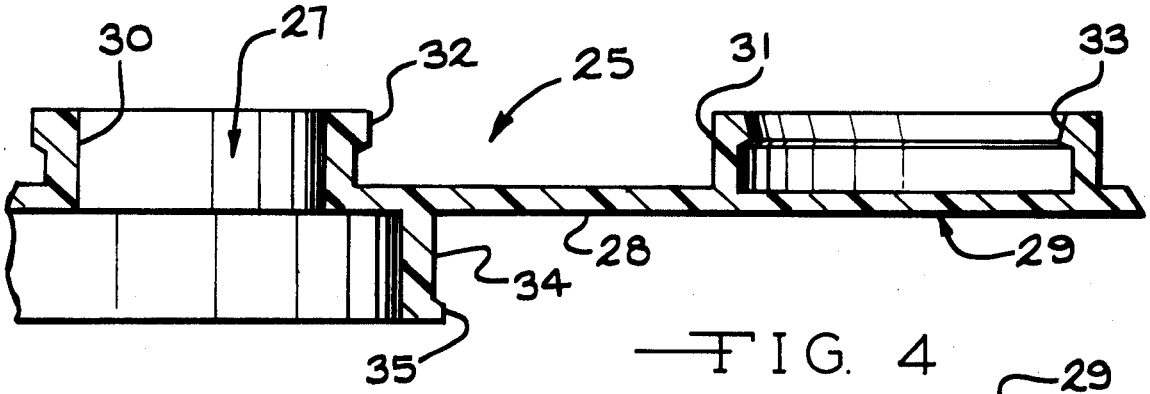
FIG. 4 is a fragmentary, vertical sectional view of a portion of a modified closure embodying the invention.
Figure 5:
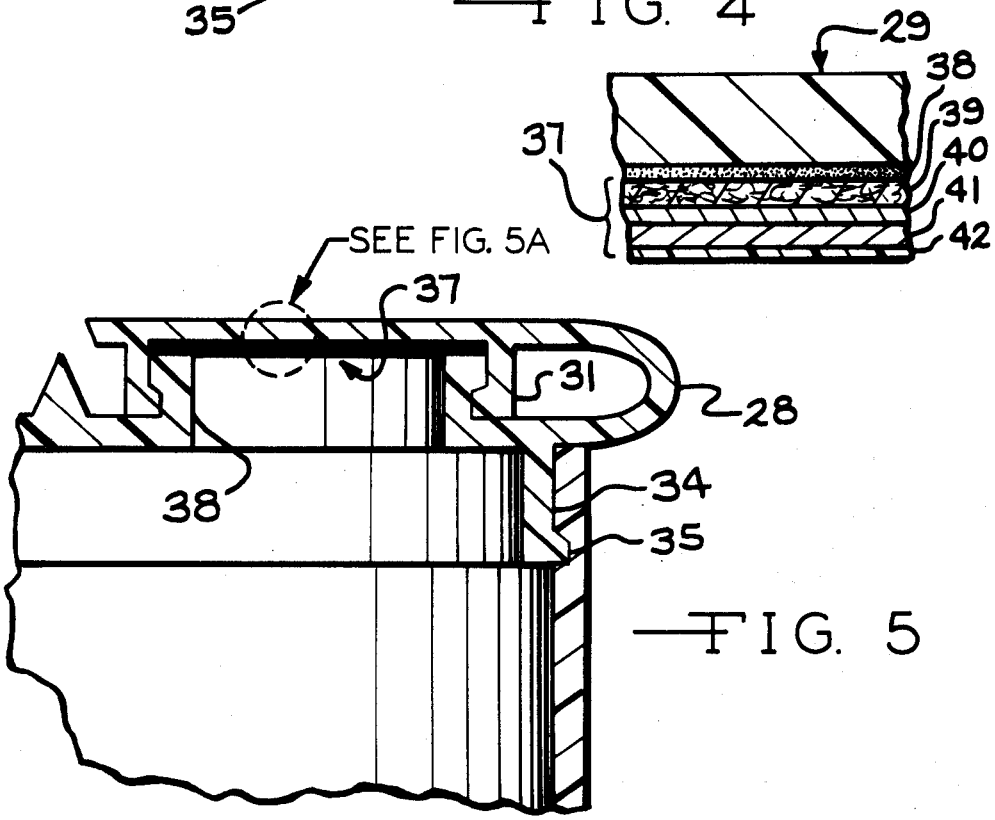
FIG. 5 is a view similar to FIG. 4 but showing the closure of FIG. 4 in closed position on a container and illustrating the utilization of a closure liner.
Figure 6:
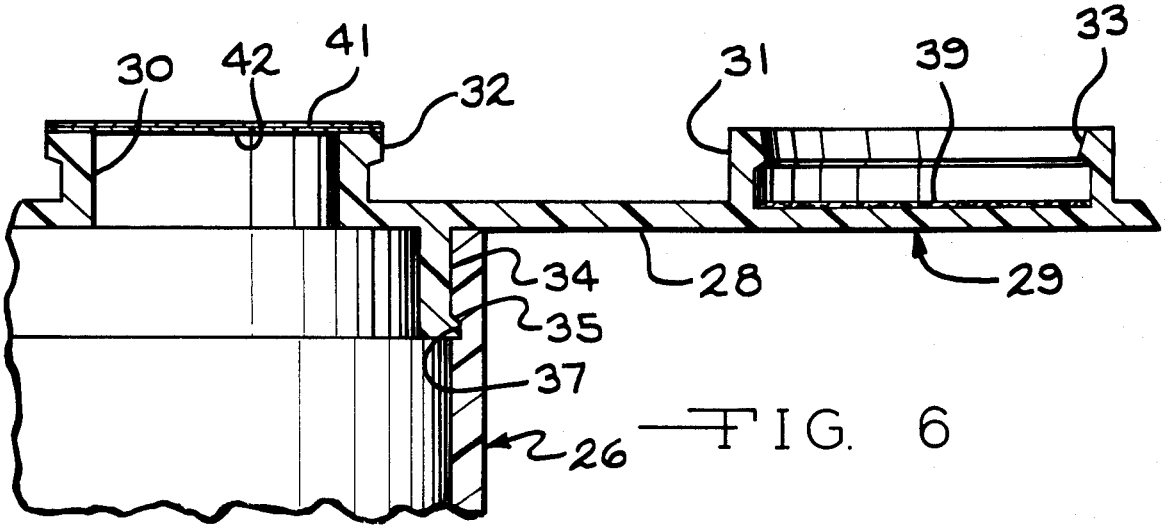
FIG. 6 is a view similar to FIG. 5 showing the closure in open position prior to the destruction of a tamper indicating sealing element.

FIGS. 4–6 show a portion of a closure 25 embodying the invention as modified to be inserted into the end of a container 26 fabricated, for example, by blow-molding from polyethylene.

A closure 25 according to the invention and illustrated in FIGS. 4–6, is substantially the same as that of FIGS. 1–3, inclusive, but is modified in order for it to be attached to the end of a plastic container 26. Like the closure of FIGS. 1–3, inclusive, the closure 25 has one or more dispensing openings, one such opening 27 being shown. The closure 25 also has an integral hinge 28 and a lid 29 for each opening. There is a top rim 30, a lid rim 31 and the rims 30 and 31 have opposed lips 32 and 33.

The closure 27 has a skirt 34 which has an outwardly extending rib 35 at or near its lower edge, the lip 35 being adapted to snap into a circular groove 36 formed in the inner wall of the container 26 near its upper edge, the interengagement of the rib 35 in the groove 36 serving to retain the closure 25 in place on the end of the container 26.

FIGS. 5, 5A, and 6 also illustrate how a tamper-indicating and sealing liner 37 may be utilized in a closure embodying the invention. The liner 37 in the form illustrated is adhered to the lid 29 by a thin glue layer 38 (see FIG. 5A) and consists of a layer of pulp 39, a thin layer of a meltable wax 40, and a layer of aluminum foil 41 which has on its exposed surface a thin layer of thermo-plastic film 42.

After the closure 25 is molded in the configuration illustrated in FIG. 4, the liner 37 is inserted into the lid 29 and glued in place by the glue 38. The lid 29 is then folded over into the closed position illustrated in FIG. 5 with the resin coated aluminum foil 41 pressed against the edge of the top rim 30. The closure 25 is then passed through an induction heating field which heats the aluminum to melt the wax layer 39 and soften the resinous film layer 42 to seal it and the aluminum foil to the rim 30.

The closure 25 is then ready to be shipped to the location where the content material is filled into the container 26 and the closure 25 inserted into the end of the container 26. The filled containers with the attached closures are then shipped to the distributor, and, eventually, to the final customer who wishes to dispense the contained material.

When the final customer wishes to dispense the material, he swings the lid 29 over into the position illustrated in FIG. 6. This exposes the aluminum foil 41 which immediately indicates whether or not the container has been tampered with. The user then cuts away the aluminum foil 41 to open the dispensing opening 27. After the desired quantity of the material has been dispensed, the container again may be closed by swinging the lid over into closed position squeezing the pulp layer 39 tightly against the remaining ring of aluminum foil 41.

Figure 7:
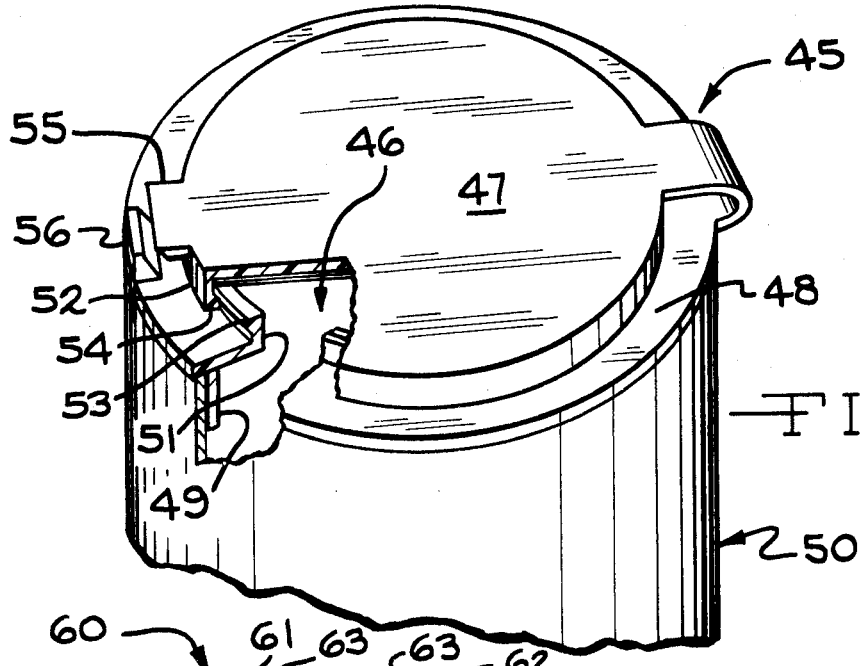
FIG. 7 is a fragmentary view in perspective, with parts broken away, showing a modified form of closure embodying the invention.

FIG. 7 illustrates an embodiment of the invention in which a closure 45 has only a single dispensing opening 46 and, therefore, has a single lid 47. In common with the earlier embodiments of the invention, the closure 45 has a circular top 48, a hinge 47 and a skirt 49 which is inserted into the end of a tubular container 50. The top 48 has a rim 51 and the lid 47 has a rim 52, the rims 51 and 52 having overlapping ribs 53 and 54, respectively. Also as in the other embodiments of the invention, the lid 47 has an outwardly protruding ear 55 and there is a fulcrum 56 near the edge of the top 48, the ear 55 and fulcrum 56 being closely spaced from each other when the lid 47 is in the closed position illustrated in FIG. 7.

Figure 8:
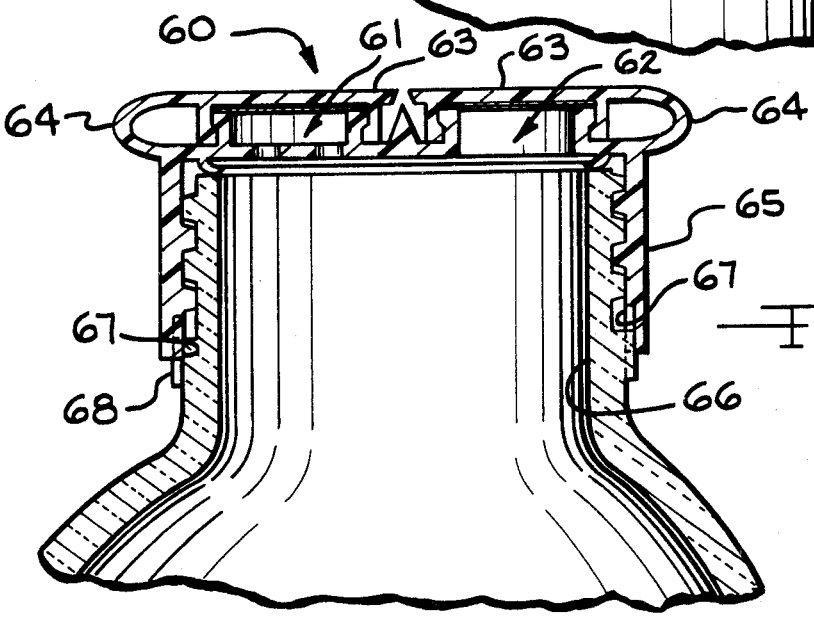
FIG. 8 is a fragmentary, vertical sectional view showing a closure embodying the invention as it would be designed for utilization on the neck of a threaded container.

A closure 60 shown in FIG. 8 is similar to the closure of FIGS. 1–3 and 4–6, having two dispensing openings 61 and 62 with corresponding lids 63 and hinges 64. In this instance, however, the closure 60 has a threaded skirt, which mates with a threaded neck 66 of a container 67 fragmentarily shown. In addition, the lower edge of the skirt 65 and the container neck 66 have cooperating one way ratchet teeth 67 and 68 so that after the closure 60 is threaded on to the neck 66 it cannot be removed, thus preventing a child from getting access to the content material.

Figure 9:
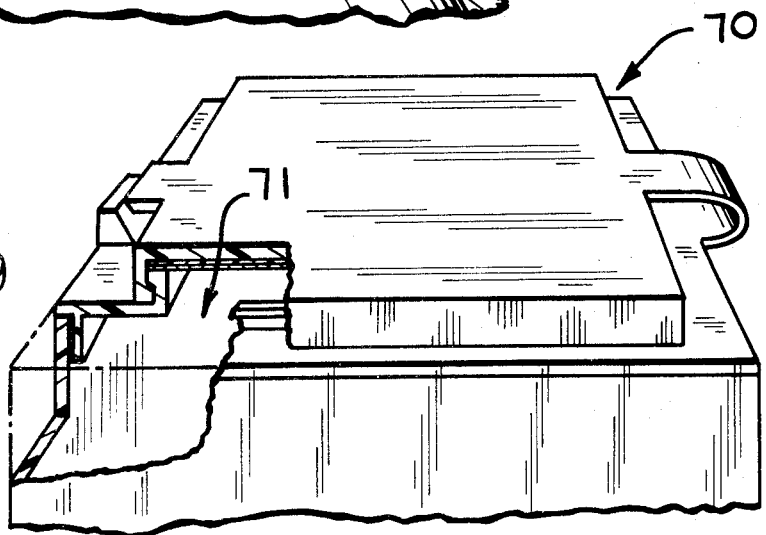
FIG. 9 is a fragmentary view in perspective of yet another embodiment of the invention, particularly one intended for use on the end of a container having a square or rectangular shape.

FIG. 9 illustrates how a closure 70 embodying the invention is configured in order to close a dispensing opening 71 of a square ended container 72. With the exception of the square configuration of the closure 70 and the container 72, the features of the closure 70 are substantially identical to those of the closure 45 shown in FIG. 7.

We claim:

1. A one-piece, child-resistant, dispensing closure for a container having an open, circular upper end, said closure being formed of a stiffly resilient material and comprising, (a) a skirt adapted to telescopingly mate with the open end of said container, (b) a disk-like top integral with said skirt and extending across the space defined by said skirt, said top having two dispensing openings therethrough, (c) an upwardly extending, integral top rim on said top surrounding each of the dispensing openings therein, (d) a lid for each of said openings, (e) a hinge for each of said lids that is integral with said top and with the respective one of said lids, said hinges extending outwardly from opposite sides of said top, (f) an integral lid rim on each of said lids that is adapted to mate with the associated one of said top rims when said lid is swung over into closed position overlying the respective one of said openings, (g) overlapping ribs on said top rims and said lid rims which are interengaged when said lids are in closed position, (h) means for retaining said closure in place on the end of said container, and (i) cooperating means consisting of a fulcrum at the center of the top and an ear on the inner side of each of the lids which extends inwardly to closely spaced adjacency to said fulcrum when said lid is in closed position thereby providing a space into which pry-means may be inserted for disengaging the ribs and moving said lid away from closed position.

2. A closure according to claim 1 and further comprising a tamper indicating liner attached in sealing relationship to each of said top rims.

* * * * *